US005397506A

United States Patent [19]

Groth et al.

[11] Patent Number: 5,397,506

[45] Date of Patent: Mar. 14, 1995

[54] SOLID CLEANER

[75] Inventors: Dale W. Groth, Edina; Terry J. Klos, Victoria; Margaret M. Cleary, West St. Paul, all of Minn.

[73] Assignee: Ecolab Inc., St. Paul, Minn.

[21] Appl. No.: 109,939

[22] Filed: Aug. 20, 1993

[51] Int. Cl.[6] ..... C11D 1/14; C11D 1/75; C11D 1/83; C11D 3/37

[52] U.S. Cl. ..... 252/547; 252/548; 252/544; 252/553; 252/559; 252/558; 252/174; 252/174.21; 252/174.23; 252/174.24; 252/DIG. 4; 252/DIG. 2; 252/DIG. 1

[58] Field of Search ..... 252/547, 548, 544, 553, 252/559, 558, 170, 174, 174.21, 174.23, 164, 174.22, 174.24, DIG. 4, DIG. 2, DIG. 1

[56] References Cited

U.S. PATENT DOCUMENTS

| | | | |
|---|---|---|---|
| 3,931,034 | 1/1976 | Inamorato et al. | 252/547 X |
| 4,133,779 | 1/1979 | Hellyer et al. | 252/547 |
| 4,276,205 | 6/1981 | Ferry | 252/547 X |
| 4,287,080 | 9/1981 | Siklosi | 252/540 X |
| 4,316,824 | 2/1982 | Pancheri | 252/551 |
| 4,680,134 | 7/1987 | Heile et al. | 252/160 |
| 4,681,704 | 7/1987 | Bernardino et al. | 252/546 |
| 4,687,592 | 8/1987 | Collins et al. | 252/546 X |
| 4,913,963 | 4/1990 | Lavallee | 428/379 |
| 4,938,893 | 7/1990 | Copeland et al. | 252/547 X |
| 5,183,534 | 2/1993 | Fjare et al. | 156/668 |
| 5,207,951 | 5/1993 | Sauer et al. | 252/547 |
| 5,213,588 | 5/1993 | Wong et al. | 51/293 |
| 5,233,115 | 8/1993 | Wu | 585/521 |
| 5,292,445 | 3/1994 | Fjare et al. | 252/79.5 |
| 5,332,528 | 7/1994 | Pan et al. | 252/548 |

FOREIGN PATENT DOCUMENTS

| | | | |
|---|---|---|---|
| 0993044 | 5/1965 | United Kingdom | 252/547 |

OTHER PUBLICATIONS

Matson, T., "Recent Advances in Fatty Amine Oxides", *J. Amer. Oil. Chem. Soc.*, 1962, 40, 640–2.

Solitaire ® Formulation.

*Primary Examiner*—Paul Lieberman
*Assistant Examiner*—Douglas J. McGinty
*Attorney, Agent, or Firm*—Merchant, Gould, Smith, Edell, Welter & Schmidt

[57] ABSTRACT

Improved cleaners for hard surfaces, cooking utensils, laundry and other substrates that can accumulate fatty soils can be cleaned using an aqueous cleaner made from a cast solid cleaning system. The cast solid system contains a carefully balanced formulation of cleaning ingredients that provide surprising animal or vegetable fat removing properties. The cleaning system can be manufactured in the form of a large bulk cast block. Such blocks are dispensed by spraying a dispensing spray of water onto the surface of the block creating an aqueous concentrate that can be directed to a cleaning site. The solid composition contains a unique blend of a specific amine oxide combined with anionic sulfonates in a solvent containing mass. These unique components cooperate to provide a substantial level of animal or vegetable fat removal in preferred cleaning protocols.

17 Claims, No Drawings

SOLID CLEANER

FIELD OF THE INVENTION

The invention relates to cleaning compositions that can be used for the removal of soils that are predominantly fatty in nature from a variety of substrates. Such soils can contain fats or oils derived from animal or plant sources but can also contain proportions of proteinaceous residues and carbohydrate or polysaccharide materials along with inorganic soils. Such soils predominantly arise on hard surfaces, on cooking implements, in laundry, as a result of food preparation or food services, etc. Such substrates include table linen, clothing, pots and pans, hard surfaces or any other fabric or hard surface that can be contaminated with typically fatty soils. The cast solid compositions of the invention can be combined with water to form aqueous solutions or suspensions of cleaning ingredients in a water diluent which can be used in cleaning protocols.

BACKGROUND OF THE INVENTION

Aqueous cleaning compositions that are formulated for removing fatty soils from a variety of substrates have been developed and have been used for many years. A large variety of different types of formulations have been developed to remove fat containing soils from a variety of surfaces.

One type of cleaner for fatty soil are highly caustic institutional cleaners that chemically saponify fats and remove the saponification reaction products which are more water soluble than the fat precursor. These materials operate using strong bases such as a sodium or potassium hydroxide or silicate in combination with other soil suspending and removing compositions. A second type of cleaner comprises an active enzyme composition in an effective cleaning formulation. The enzyme acts to remove fat from a substrate by the natural action of the enzyme in breaking the fat down into its constituent substances which can be removed by surfactants or other components in a formulated cleaner. Still a further form of cleaning composition comprises a formulated cleaner that relies on the action of anionic, cationic, nonionic and amphoteric surfactants in combination with other adjuvants to interact with, suspend and remove fatty soils from a typical substrate. The ability of surfactant materials to interact with fats at a lipid-water interface to improve the dispersibility or solubility of fats in the medium is well known. Surfactant systems for the removal of soils generally, and fatty soils in particular, have been developed and a large variety of proposed formulations have been suggested in the art. One material sold by Ecolab Inc. of St. Paul, Minn., known as Solitaire® comprises a cast solid material using a solidifying system comprising polyethylene glycol, molecular weight 8000, combined with sodium acetate. The solid composition comprises a surfactant blend comprising a cocoamidopropyl dimethylamine oxide, a lauric acid monoethanol amide, linear alkyl sulfonate, and other ingredients in a fully formulated cleaner. The individual components of this formulation are known ingredients in cast solid systems and are used in cleaning systems for grease or fat removal.

A continuing need exists in the art to improve materials that have had substantial success and acceptance by the market place to satisfy customer's demands for improved products. Accordingly, a substantial need exists to improve the grease cleaning properties of all materials.

BRIEF DISCUSSION OF THE INVENTION

We have found that a substantially improved aqueous cleaner material can be made in a cast solid cleaner system. We have found that the degree of fat removal from hard surfaces, fabrics and other soiled substrates can be substantially improved through a formulation containing a $C_{12-18}$ alkyl dimethylamine oxide combined with an anionic system comprising a fatty ether sulfate and an anionic sulfonate surfactant in combination with other ingredients in a cast solid cleaner system. We have further found that an improved solidification system can be used in making the cast solid detergent by combining the polyalkylene glycol casting agent with an alkali metal salt of a weak organic acid and urea. Such a system can improve the manufacture and reliability and rate of solidification of this system and can also improve the properties of the material. Combining the polyalkylene glycol casting agent with urea and an alkali metal salt of a weak organic acid improves the hardness and manufacturing reliability of the systems and provides emolliency to aqueous systems containing the casting agent in a diluted cleaning system.

The preferred cast solid cleaning systems of the invention comprise a $C_{12-18}$ alkyl dimethylamine oxide, an anionic surfactant system comprising a fatty ether sulfate and an anionic sulfonate surfactant, a fatty acid alkanol amide and a polyalkylene glycol based casting agent. We have found that the amine oxide surfactant, the alkyl ether sulfate and the anionic surfactant cooperate to provide a level of fat removal that is unique and surprising in view of the ability of the prior art materials to remove fat. We have also found that the unique casting agent used in the invention comprising a polyalkylene glycol, a alkali metal salt of a weak organic acid, and urea improves the cast solid material manufacturing reliability and provides a cast material that can be diluted to form a cleaning system having emollient properties.

DETAILED DISCUSSION OF THE INVENTION

The invention comprises an unique blend of surfactants in an improved casting system. The surfactants comprise alkyl dimethylamine oxide combined with an anionic system containing a fatty ether sulfate and an anionic sulfonate. The casting system comprises a polyalkylene glycol urea and an alkali metal salt of a weak acid.

Amine oxide compositions that are useful in combination with the other ingredients of the invention include $C_{12-16}$ alkyl dimethylamine oxides having the formula:

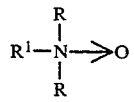

wherein R is a $C_{1-4}$ alkyl and $R^1$ comprises a $C_{12-18}$ preferably a $C_{12-16}$ alkyl. The alkyl dimethylamine oxide can comprise an amine oxide having a single alkyl group or a mixture of alkyls or a range of carbon numbers in the alkyl group. Accordingly, preferred amine oxide surfactants comprise a dodecyl dimethylamine oxide, tetradecyl dimethylamine oxide, hexadecyl dimethylamine oxide, or mixtures thereof. Most preferred amine oxide comprises a tetradecyl dimethylamine oxide having some proportion of other amine oxides in the composition.

The improved cast solid cleaner compositions of the invention combines an anionic surfactant system with the amine oxide surfactant described above. The anionic surfactant system comprises a $C_{6-24}$ alkyl ether sulfate surfactant an anionic surfactant comprising a $C_{6-24}$ alkyl benzene sulfonate, preferably a $C_{8-16}$ and/or a $C_{6-24}$ alkyl sulfate alkyl benzene sulfonate. The alkyl ether sulfate material has the following formula:

$$R^2—O—SO_3^-X^+$$

wherein $R^2$ is a $C_{6-24}$ alkyl group or a $C_{6-24}$ alkyl—$(OCH_2CH_2)_n$—, n is 1–10 and $X^+$ is an alkyl metal cation, hydrogen ion or ammonium. The alkyl ether sulfate can be a single composition having a $C_6$ alkyl group, a $C_{12}$ alkyl group, a $C_{20}$ alkyl group, or a $C_{24}$ alkyl group or can be a mixture of compositions having varying chain lengths. Further, R can comprise an ethoxylated fatty alcohol which is then reacted to form an ethoxylated fatty alcohol sulfate. The ethoxylated material can contain from 1 to 10 moles of ethylene oxide per mole of fatty alcohol. A preferred blend of anionic surfactants comprises 20–25 wt. % of dodecyl benzene sulfonate, 4–8 wt. % of a sodium lauryl sulfate and 5–12 wt. % of sodium lauryl ether sulfate.

The ether sulfate surfactant can be combined with a second anionic surfactant material containing a strong anionic group. Such anionic detergents contain typically anionic groups selected from the group consisting of sulfonic, sulfuric, phosphoric, phosphonic or carboxylic acid groups which when neutralized will yield sulfonate, sulfate, phosphonate or carboxylate groups with an associated cation, preferably selected from the group consisting of an alkali metal, ammonium alkanol amino, preferably sodium ammonium or triethanolamino. Examples of preferred operative anionic surfactants include sulfonate materials of the formula:

wherein $R^3$ is a $C_{6-24}$ alkyl group, a group of the formula: $C_{6-24}$ alkyl—$(OCH_2CH_2)_n$—; or a $C_1$–$C_{24}$ alkyl substituted benzene group, n is 1 to 10, and $X^+$ is an alkali metal cation or ammonium. Examples of the surfactant are compounds such as alkyl benzene sulfonate, sodium xylene sulfonate, sodium dodecyl benzene sulfonate, sodium linear tridecyl benzene sulfonate, potassium octyldecyl benzene sulfonate, sodium lauryl sulfate, sodium olefin sulfonate, and others. Preferred anionic sulfonate materials comprise dodecyl benzene sulfonate or sodium salt.

The cleaning compositions of the invention can contain a compatible solvent material. Suitable solvents are hydroxy substituted hydrocarbon materials that are compatible with the solid aqueous cleaning composition. Preferred solvent materials include lower alkanols, $C_{1-12}$ alkylene glycols, lower alkyl ethers, lower alkyl glycol ethers, etc. These materials are typically colorless liquids with a mild or pleasant odor, are excellent solvents and coupling agents and are typically miscible or suspendible with the aqueous cleaning compositions after dilution. Examples of such useful solvents include methanol, ethanol, propanol, isopropanol, n-butanol, isobutanol, ethylene glycol, diethylene glycol, triethylene glycol, propylene glycol, dipropylene glycol, mixed ethylene propylene glycol ethers. The glycol ethers include lower alkyl ($C_{1-8}$ alkyl ethers including propylene glycol, methyl ether, dipropylene glycol methyl ether, dipropylene glycol ethyl ether, tripropylene glycol ethyl ether, tripropylene glycol methyl ether, ethylene glycol methyl ether, ethylene glycol ethyl ether, ethylene glycol diethyl ether, ethylene glycol methyl ether, and others.

The cast solid compositions of the invention can also contain a fatty acid amide material. The amide material provides additional surfactancy to the cast solid materials. The preferred fatty acid amide compositions are made by reacting a free fatty acid or mixtures thereof with either a monoalkanol amine or a dialkanol amine. Typically, the fatty acid amide materials are made from substantially saturated fatty acid materials and can comprise a $C_{6-24}$ fatty acid or mixtures thereof. Examples of such acids include caprylic acid ($C_6$), caproic acid ($C_8$), capric acid ($C_{10}$), lauric acid ($C_{12}$), myristic acid ($C_{14}$), palmitic acid ($C_{16}$), stearic acid ($C_{18}$), eicosanoic acid ($C_{20}$), docosanoic acid ($C_{22}$), tetracosanoic ($C_{24}$), and mixtures thereof. While saturated fatty acids are preferred, unsaturated fatty acids can also be used in making the amide materials used in the invention.

The fatty acids are typically reacted with a monoalkanol or dialkanol amine compound. Preferred amines comprise monoethanol amine or diethanoi amine resulting in a fatty acid monoethanol amide or a fatty acid diethanoi amide of the formula:

$$R^4—\overset{\overset{\displaystyle O}{\|}}{C}—NH—R^5—OH \text{ or } R^4—\overset{\overset{\displaystyle O}{\|}}{C}—N[R^5—OH]_2$$

wherein $R^4$ is a $C_{6-24}$ alkyl, and $R^5$ is a $C_{2-6}$ alkylene.

In addition to the recited components of the composition of the invention, there may also be present adjuvant materials for cleaning a variety of substrates. Such adjuvant materials may include foam enhancing agents, foam suppressing agents, preservatives, antioxidants, pH adjusting agents, perfumes, colorants, or pearlescent agents, builder salts, cosolvents and other well known and well understood adjuvant materials.

The following Table contains suggested formulations for the cast solid material of the invention. The Table contains indications of the useful and preferred concentrations of the amine oxide compound, the anionic surfactant system, fatty acid amide, the hydroxy solvent and the solidifying agent. Within the Table it is shown the preferred blends for the anionic surfactant and the solidifying system. Within the anionic surfactant system or the solidification system, one or more of the three components can be omitted while retaining substantial function, however a preferred system contains at least some proportion of all three parts of both the anionic surfactant system and the solidification system.

FORMULATIONS

| | Parts by Weight | |
|---|---|---|
| | Useful | Preferred |
| Amine oxide compound | 5–25 | 10–15 |
| Anionic surfactant system | 15–70 | 30–50 |
| alkyl ether sulfate | 2.5–20 | 5–15 |
| alkyl benzene sulfate | 10–30 | 20–25 |
| alkyl sulfate | 2.5–20 | 5–10 |
| Fatty acid amide | 5–20 | 10–15 |
| Solidifying system | 10–60 | 20–45 |
| PEG (mw 5000–15,000) | 30–50 | 10–40[1] |
| Urea | 2.5–20 | 5–15 |

-continued

| FORMULATIONS | Parts by Weight | |
|---|---|---|
| | Useful | Preferred |
| Alkali metal salt | 2.5–10 | 5–10[2] |

[1]Preferred m.w. = 6,000–10,000
[2]Preferred salt is sodium acetate.

A preferred casting agent comprises 5–30 wt. % of a polyethylene glycol, 5–15 wt. % of urea and 1–10 wt. % of sodium acetate, the percentages based on the cast solid composition. A preferred solid cleaning composition comprises an effective surfactant system useful in removing food soils preferably 5–15 wt. % of a $C_{12-18}$ alkyl dimethyl amine oxide, 10–60 wt. % of a surfactant system comprising at least 1 wt. % of a $C_{6-18}$ alkyl benzene sulfonate, at least 1 wt. % of a $C_{6-18}$ alkyl sulfate and at least 1 wt. % of a $C_{6-24}$ alkyl ether sulfate, about 5–20 wt. % of a fatty monoethanol amide, a casting agent comprising about 5–30 wt. % of a polyethylene glycol having a molecular weight of about 5000–15,000, about 5–15 wt. % of urea and about 1–10 wt. % of an alkali metal salt of a weak organic acid, each percentage based on the total cast solid composition.

The cast solid compositions of the invention are typically used by diluting the cast solid material in a sufficient proportion of water to reach a dilution of about 0.1–5 parts by weight of the cast solid concentrate material per each 1000 parts of water. Such dilutions can be made by manually dividing the cast solid material into small portions which can be combined with aqueous diluents through manual mixing and diluting mechanisms. However, a preferred mode for dispensing the material comprises the use of a spray-on dispenser. Such dispensers are sold by Ecolab Inc. and are sold under the tradenames Hydromatic® and Electromatic®. Such dispensers are either automatically operated or manually operated. Manually operated dispensers when energized by hand direct a spray of water against the cast solid material. The spray dissolves a sufficient quantity of the material to manufacture a concentrate or a use solution of consistent dilution of the cast solid in a water diluent. The concentrate manufactured by directing a spray against the cast solid can be used as is or can be further diluted by combining the concentrate with further proportions of diluent water to make a use solution. Typically the materials dispensed by either the automatic or manual dispenser systems of the invention result in a concentrate containing from about 1–20 wt. % of the material in an aqueous diluent. The material of the invention is typically used in a use solution at a concentration of about 0.01–0.2 wt. %, preferably about 0.03–0.1 wt. % in the aqueous diluent. When used, the cast solid materials of the invention are dispensed using the dispensers described above in the form of an aqueous use material. The diluted use material can be directly contacted with a hard surface or laundry application for removal of fatty soils from the substrates. We have found a preferred or optimal pH range for the compositions of the invention. We have found that the performance of the materials optimized at a pH of between about 7.5 and about 13, preferably about 7.5 and 10. The preferred substrate for use with the compositions of the invention is a metallic, glass or ceramic hard surface including pots and pans. In use the material is dispensed as described above, introduced into a dishwashing location in which the soiled food preparation equipment including pots and pans can be immersed and soaked for a time period. After soaking softens and promotes soil removal from the surfaces, the pots and pans can be washed by hand using a wipe, scrub pad, brillo pad or other abrasive device to further promote soil removal. We have found that the compositions of the invention are simple to use in manual dishwashing, pot and pan washing, hard surface or floor cleaning compositions that can also be used in laundry or other fabric cleaning applications. The materials of the invention are high performance, but are of moderate cost. We have found that the materials of the invention have a quantifiable increase in grease cutting performance over prior materials sold in the market and in particular appear to be 200–300 % improvement in grease cutting over Ecolab's Solitaire® cleaner.

The material is typically made in large cast solid units that can comprise from about 250 grams to 5 kilograms. Preferably the material is used in a cast solid mass that ranges from about 1.5 to 3 kilograms. The material can be cast in disposable rigid plastic containers or can be cast removed from the mold and wrapped in disposable sheet-like wrapping material. Useful wrapping materials include paper, coated paper, polyethylene, polyester, metallized polyester, non-wovens, foils, and other low cost disposable sheet-like packaging materials. The materials can be dispensed by inserting the cast material formed in a disposable container into a dispenser. The dispenser can then dispense the cast solid material from the disposable container until the container is empty at which time the container is replaced with a container with a fresh charge of material. Alternatively, the material can be popped out of such a flexible plastic container or can be removed from a tear open wrapping as described above. The cast material free of any container or wrapping can be inserted into a dispenser singly or in a magazine format using two or more cast solid materials and can be dispensed using a water spray.

The following examples and data provide a basis for understanding the properties and manufacture of the invention. The examples and data further comprise the best mode.

Example 1

Into an appropriately sized heated container with a electrically driven agitator mechanism heated to 190° F. is placed 9.25 parts of a polyethylene glycol having a molecular weight of about 8000 and 2.3 parts of sodium acetate. The contents of the container are melted and mixed until uniform. Into the uniform melt is placed 5.1 parts by weight of a lauric acid monoethanol amide and 11.55 parts of a dodecyl benzene sulfonic acid sodium salt (90 wt. % active) along with about 0.25 part of hexylene glycol. The contents of the container are mixed until uniform and into the melt is placed 3.25 parts by weight of lauryl sulfate sodium salt, 5.1 parts by weight of a $C_{14}$ dialkyl dimethyl amine oxide (85 wt. % active), 6.95 parts of sodium lauryl ether sulfate, 5.298 parts by weight of urea followed by small amounts of dye and fragrance. The balance of the hexylene glycol is added to a total of 0.9 total part by weight of hexylene glycol. The contents of the container are agitated until uniform. The agitation is removed and the contents of the container are poured into flexible plastic disposable molds where the material solidifies into a hard solid at room temperature.

A series of test formulations were made to test cleaning properties. The formulations the active components of the useful formulations.

TABLE 1

| | (Parts By Weight) | | | |
|---|---|---|---|---|
| | EXAMPLE | | | |
| INGREDIENT | 2A | 2B | 2C | 2D |
| Cocoamidopropyl amine oxide | 14.92 | — | — | 14.92 |
| $C_{14}$ alkyl dimethyl amine oxide | — | 5.26 | 10.52 | — |
| Sodium lauryl ether sulfate | 7.44 | 7.44 | 7.44 | 7.44 |
| Lauric acid monoethanol amide | 5.29 | 5.29 | 5.29 | 5.29 |
| Sodium dodecyl benzene sulfonate | 15.89 | 15.89 | 10.52 | 10.52 |
| $MgSO_4$ (anhydrous) | — | — | — | 0.25 |
| $CaCl_2.2H_2O$ | — | — | — | 1.01 |

Generally following the procedure of Example 1, the test formulations of Table 1 were prepared. These materials were tested for grease removal using a gravimetric test protocol in which a layer of grease added to a glass beaker is removed solely by the action of a uniformly agitated solution of the compositions of the invention at a controlled temperature. In testing the compositions, a test fat material comprising 87.5 parts of Mazola oil and 12.5 parts of stearin, a tri stearic acid glycerol triester, were mixed until uniform. A small portion of the test fat (about 15 grams) is layered on the bottom of a glass beaker. The beaker plus fat is weighed to determine a pretest weight. A cleaning solution is made by mixing about 2.5 parts by weight of the materials of Examples 2A, 2B, 2C or 2D with water to make about 100 parts of an aqueous cleaner.

In the test formulas, Examples 2A and 2D represent prior art materials using the cocoamidopropanol amine oxide while materials 2B and 2C represent compositions of the invention using the $C_{14}$ alkyl dimethylamine oxide material. Approximately 100 grams of the diluted cleaner are added to the beaker. A propeller agitator is inserted into the liquid ensuring that the propeller does not touch the test soil layer in the bottom of the beaker. The agitator is initiated and is continued at a constant rpm for a fixed period of time.

The following Table 2 provides data derived using the protocol testing Examples 2A, 2B, 2C, and 2D.

TABLE 2

| | | GREASE REMOVAL EVALUATION | | | | |
|---|---|---|---|---|---|---|
| PRODUCT | INITIAL WEIGHT | SOILED WEIGHT | CLEANED WEIGHT | PERCENT REMOVED | AVERAGE | pH |
| Dawn ® | 48.69 | 65.29 | 60.74 | 27.41 | | |
| 6.9% sol'n | 48.42 | 64.8 | 60.99 | 23.26 | 26.04 | — |
| | 48.58 | 64.82 | 60.36 | 27.48 | | |
| 2A | 48.59 | 64.58 | 63.24 | 8.38 | | |
| 2.5% sol'n | 48.25 | 63.99 | 62.46 | 9.72 | 8.56 | 7.05 |
| | 49.1 | 65.73 | 64.47 | 7.58 | | Clear |
| 2A | 48.08 | 65.01 | 64.97 | 0.24 | | |
| 2.5% sol'n | 48.05 | 65.25 | 65.22 | 0.18 | 0.20 | 8.97 |
| | 49.08 | 66.24 | 66.21 | 0.17 | | Clear |
| 2B | 48.07 | 64.75 | 64.53 | 1.32 | | |
| 2.5% sol'n | 48.95 | 65.55 | 65.32 | 1.39 | 1.45 | 7.12 |
| | 48.28 | 64.61 | 64.34 | 1.65 | | Opaque |
| 2B | 48.24 | 64.79 | 61.11 | 22.24 | | |
| 2.5% sol'n | 49.25 | 65.57 | 61.94 | 22.24 | 22.74 | 8 94 |
| | 47.92 | 64.27 | 60.39 | 23.73 | | Clear |
| 2C | 48.32 | 64.35 | 64.37 | −0.12 | | |
| 2.5% sol'n | 48.68 | 65.21 | 65.25 | −0.24 | −0.16 | 7.10 |
| | 48.21 | 65.15 | 65.17 | −0.12 | | Opaque |
| 2C | 49.12 | 65.78 | 61.61 | 25.03 | | |
| 2.5% sol'n | 48.45 | 64.72 | 60.56 | 25.57 | 25.04 | 9.11 |
| | 48.39 | 64.83 | 60.8 | 24.51 | | Clear |
| 2D | 48.73 | 65.41 | 63.18 | 13.37 | | |
| 2.5% sol'n | 48.12 | 64.47 | 62.27 | 13.46 | 13.08 | 7.15 |
| | 48.68 | 65.48 | 63.39 | 12.43 | | Cloudy |

In Table 2 the representative materials of the prior art, Examples 2A and 2D are compared to examples of the invention 2B and 2C and are compared with a liquid commercial dishwashing product Dawn®. The Dawn® material is used at a 6.9 wt. % active solution while the example materials are used at 2.5 wt. %. The data shown in the Tables show two effects. First, the substitution of the $C_{14}$ dimethylamine oxide material for the cocoamidopropylamine oxide material results in a substantially improved cleaning property when used at a pH above 7.5. The data clearly supports the substantial improvement in cleaning efficiency when an alkyl dimethylamine oxide material is combined with a sodium alkyl ether sulfate in a solidified cast material made using the polyethylene glycol urea sodium acetate casting system. While the specification, examples and data provide a basis for understanding the meets and bounds of the invention, the invention can be embodied in a number of embodiments without departing from the spirit and scope of the invention. The invention resides in the claims hereinafter appended.

We claim:

1. A solid cast cleaning composition consisting essentially of:

(a) an amine oxide surfactant of the formula:

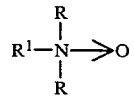

wherein R is a $C_{1-4}$ alkyl and $R^1$ comprises a $C_{12-16}$ alkyl;

(b) an anionic surfactant system comprising a blend of an alkyl sulfate or an alkyl ether sulfate of the formula:

$R^2—O—SO_3X^+$ and an anionic sulfonate surfactant of the formula:

$$R^3—SO_3^-X^+;$$

wherein $R^2$ is a $C_{6-24}$ alkyl group, a group of the formula:

$$C_{6-24}alkyl—(OCH_2CH_2)_n—$$

$R^3$ is $R^2$ or a $C_1C_{24}$ alkyl substituted benzene group, n is 1 to 10, and $X^+$ is an alkali metal cation or ammonium;

(c) a fatty amide composition of the formula:

$$R^4—\overset{O}{\overset{\|}{C}}—NH—R^5—OH \text{ or } R^4—\overset{O}{\overset{\|}{C}}—N[R^5—OH]_2$$

wherein $R^4$ is a $C_{6-24}$ alkyl, $R^5$ is a $C_{2-6}$ alkylene; and (d) a casting agent comprising a polyalkylene glycol compound.

2. The composition of claim 1 wherein the anionic sulfonate comprises a $C_{8-16}$ alkyl benzene sulfonate.

3. The composition of claim 1 wherein the anionic sulfate comprises a $C_{8-16}$ alkyl sulfate.

4. The composition of claim 1 wherein the amine oxide is a $C_{14}$ alkyl dimethylamine oxide.

5. The composition of claim 1 wherein the casting agent additionally comprises urea.

6. The composition of claim 5 wherein the casting agent additionally comprises an alkali metal salt of an organic weak acid.

7. The composition of claim 1 wherein the fatty amide comprises a lauric monoethanol amide.

8. A cast solid cleaning composition consisting essentially of:

(a) about 5–25 wt. % of a $C_{12-18}$ alkyl dimethylamine oxide;

(b) about 15–70 wt. % of an anionic surfactant system comprising at least 1 wt. % of a $C_{6-18}$ alkyl benzene sulfonate, at least 1 wt. % of a $C_{6-18}$ alkyl sulfate and at least 1 wt. % of a $C_{6-24}$ alkyl ether sulfate;

(c) about 10–40 wt. % of a casting agent comprising at least 5 wt. % of a polyethylene glycol having a molecular weight of about 5000 to 15,000 and at least 5 wt. % of urea; and (d) about 5–20 wt. % of a fatty monoethanol amide.

9. The composition of claim 8 wherein the casting agent additionally comprises an alkali metal salt of a weak acid.

10. The composition of claim 8 wherein the anionic surfactant comprises 20–25 wt. % of dodecyl benzene sulfonate, 4–8 wt. % of a sodium lauryl sulfate and 5–12 wt. % of a sodium lauryl ether sulfate.

11. The composition of claim 8 wherein the fatty monoethanol amide comprises a lauric monoethanol amide.

12. The composition of claim 8 wherein the casting agent comprises 5–30 wt. % of a polyethylene glycol, 5–15 wt. % of urea and 1–10 wt. % of sodium acetate based on the cast solid composition.

13. The composition of claim 8 wherein the amine oxide comprises a $C_{14}$ alkyl dimethylamine oxide.

14. The composition of claim 8 wherein the alkyl benzene sulfonate comprises a dodecyl benzene sulfonate.

15. A solid cleaning composition which consists essentially of:

(a) an effective surfactant system for removing food soils;

(b) a casting agent comprising about 5–30 wt. % of a polyethylene glycol having a molecular weight of about 5000–15,000;

(c) about 5–15 wt. % of urea; and (d) about 1–10 wt. % of an alkali metal salt of a weak organic acid, each based on the total cast solid composition.

16. The composition of claim 15 wherein the weak salt comprises sodium acetate.

17. The composition of claim 1 further consisting essentially of a hydroxy substituted hydrocarbon solvent, or ether thereof, selected from the group consisting of a lower alkanol, a $C_{1-12}$ alkylene glycol or mixtures thereof.

* * * * *